United States Patent [19]

Kann

[11] Patent Number: 4,773,234

[45] Date of Patent: Sep. 27, 1988

[54] POWER SAVING REFRIGERATION SYSTEM

[76] Inventor: Douglas C. Kann, 14900 Memorial Dr., #701, Houston, Tex. 77079

[21] Appl. No.: 86,264

[22] Filed: Aug. 17, 1987

[51] Int. Cl.[4] ..... F25B 41/00

[52] U.S. Cl. ..... 62/513; 62/503; 62/509

[58] Field of Search ..... 62/513, 503, 509

[56] References Cited

U.S. PATENT DOCUMENTS

| | | | |
|---|---|---|---|
| 3,481,151 | 12/1969 | Seeley | 62/278 |
| 4,259,848 | 4/1981 | Voight | 62/513 |
| 4,316,366 | 2/1982 | Manning | 62/513 |
| 4,577,468 | 3/1986 | Nunn, Jr. et al. | 62/513 |
| 4,683,726 | 4/1987 | Barron | 62/513 |
| 4,694,662 | 9/1987 | Adams | 62/513 |
| 4,696,168 | 9/1987 | Woods et al. | 62/513 |

*Primary Examiner*—Ronald C. Capossela
*Attorney, Agent, or Firm*—Pravel, Gambrell, Hewitt, Kimball & Krieger

[57] ABSTRACT

A subcooling condenser/receiver is provided upstream of and proximate to an expansion device in a refrigeration loop, the condenser/receiver having an inlet for receiving cooled refrigerant, a receiver for accumulating the refrigerant, an integral suction line to subcool the refrigerant, and an outlet for discharging the accumulated refrigerant to the expansion device. Because the suction line is integral to the receiver, the cooled refrigerant is in thermal communication with the spent refrigerant. In order to condense and accumulate refrigerant in the receiver the subcooling condenser/receiver has a flow restricting structure which produces a pressure drop between the subcooling condenser/receiver inlet and the receiver. A liquid seal is formed at the subcooling condenser/receiver in the high pressure line extending from the compressor to the expansion device. This arrangement reduces pressure losses in the high pressure line thus improving the volumetric flow efficiency. Accordingly, a smaller load is placed on the compressor and the system's power requirements are reduced.

4 Claims, 1 Drawing Sheet

POWER SAVING REFRIGERATION SYSTEM

FIELD OF THE INVENTION

The invention relates to refrigeration or cooling systems in which the evaporation of a liquid refrigerant is used to draw heat from another medium such as air or water, and more specifically, to a method and apparatus for improving the efficiency of such systems.

BACKGROUND OF THE INVENTION

Refrigeration systems comprising an evaporating heat exchanger in which liquid refrigerants such as chlorofluorocarbons, more commonly known as refrigerants, are evaporated to draw heat from another medium such as air or water are well known. A compressor normally serves to circulate the refrigerant and has a low pressure or suction inlet which receives spent refrigerant from an evaporating heat exchanger and a high pressure outlet which discharges compressed refrigerant into a high pressure line. The compressed refrigerant is commonly received by a condensing heat exchanger, transferring heat from the compressed refrigerant to another medium, most commonly air or water. The cooled and condensed refrigerant is then conveyed along the high pressure liquid line to an expansion device which discharges the refrigerant through a narrow orifice into the evaporating heat exchanger, causing an expansion and evaporation of the refrigerant and consequently a cooling effect.

It is essential for proper and efficient operation of such a system that a liquid seal be formed in the high pressure line upstream of the expansion device. Essentially, a liquid must be presented to the high pressure inlet of the expansion device to obtain proper circulation of the refrigerant and effective cooling in the evaporating heat exchanger. This liquid seal is commonly formed at the condensing heat exchanger used to cool the compressed refrigerant, but this tends to reduce the efficiency of operation. In particular what may be described as a solid liquid line or continuous liquid line is formed between the condensing heat exchanger and expansion device, and since the condensing heat exchanger is commonly remotely located from the expansion device itself, this solid liquid line may be quite long, measuring hundreds of feet in many instances. This introduces a large pressure drop along the high pressure line and consequently requires that the compressor be sized to generate an appropriate high pressure differential to accommodate expected line losses. This in turn requires that larger operating currents be supplied to the compressor.

It is not practical in most industrial and commercial applications to locate the compressor and condenser required to cool the compressed refrigerant proximate to the expansion device in order to reduce system circulating losses. Accordingly, it is an object of the invention in one particular aspect thereof to provide an improved refrigeration system in which a liquid seal may be formed a short distance from an expansion device thereby ensuring proper volumetric flow of associated refrigerant while providing more energy efficient circulation of the refrigerant.

BRIEF SUMMARY OF THE INVENTION

In one aspect the invention provides a refrigeration or cooling system in which the evaporation of a liquid refrigerant serves as means for cooling another medium.

The system includes a first heat exchanger or evaporator in which the refrigerant is evaporated to produce the required cooling effect. The spent refrigerant is then passed through a subcooling condenser/receiver where it absorbs the heat of final condensing and subcools the liquid refrigerant. An expansion device serves to expand condensed refrigerant, the expansion device having a high pressure inlet for receiving the condensed refrigerant and a low pressure outlet which discharges the refrigerant into the first heat exchanger. A compressor serves to compress the refrigerant, the compressor having a low pressure inlet which draws the refrigerant from the first heat exchanger and a high pressure outlet which discharges the compressed refrigerant to a second heat exchanger or condenser to cool the compressed refrigerant.

The subcooling condenser/receiver is positioned upstream of and proximate to the expansion device means and serves to condense, subcool, and accumulate the cooled refrigerant prior to delivery to the high pressure inlet of the expansion device. The subcooling condenser/receiver includes an inlet which receives the cooled refrigerant from the second heat exchanger, an integral suction line which allows thermal communication with the spent refrigerant which subcools the refrigerant, a receiver which accumulates condensed, subcooled refrigerant, and an outlet which discharges the refrigerant from the receiver to the high pressure inlet of the expansion device. Means are provided for producing a pressure drop between the inlet of the subcooling condenser/receiver and the receiver.

The combination of the pressure drop and the subcooling of the refrigerant causes the formation of a liquid seal upstream of the expansion device at the subcooling condenser/receiver. This ensures proper operation of the expansion device and proper circulation of the refrigerant throughout the system. This arrangement enchances volumetric flow efficiencies and permits the high pressure flow path extending from the high pressure outlet of the compressor to the subcooling condenser/receiver to be operated without a liquid seal. Accordingly, the pressure drop which must be overcome by the compressor to properly circulate the refrigerant is markedly reduced, thereby reducing compressor power consumption.

DESCRIPTION OF THE DRAWINGS

The invention will be better understood with reference to drawings illustrating preferred embodiments in which.

DESCRIPTION OF PREFERRED EMBODIMENTS

Figure 1:
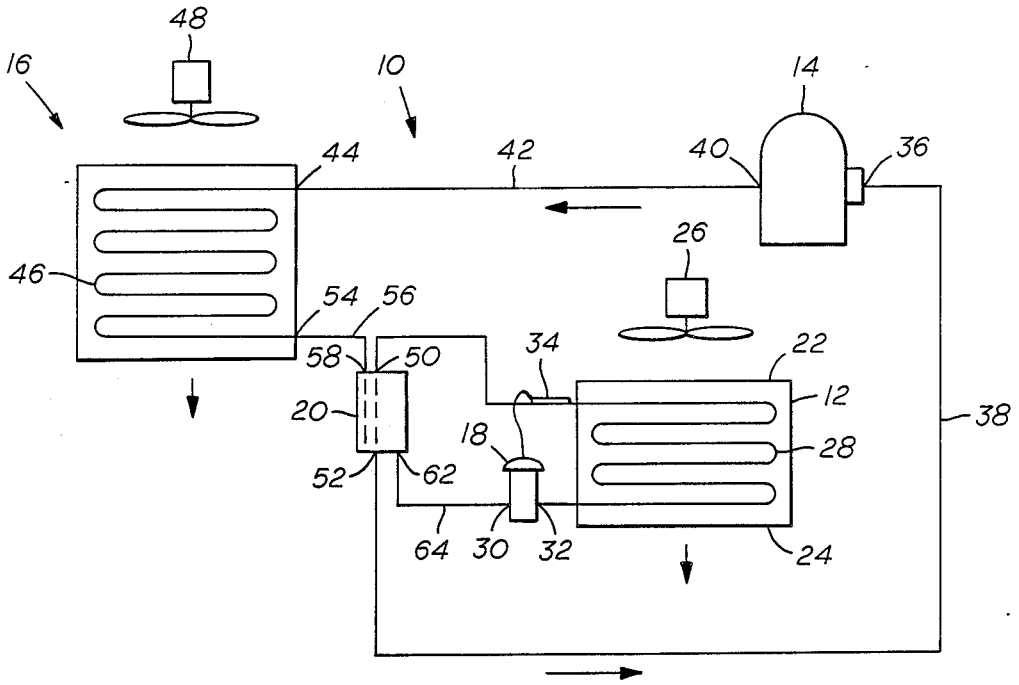
FIG. 1 is a schematic diagram of a refrigeration system appropriate for cooling air.

Reference is made to FIG. 1 which illustrates a refrigeration system 10 appropriate for the cooling of a gaseous medium such as air. The system 10 includes an evaporating heat exchanger 12, a compressor 14 which serves to compress and circulate a refrigerant throughout the system 10, a second heat exchanger 16 appropriate for transferring heat from the compressed refrigerant to a cooling medium such as ambient air, and a conventional expansion valve 18 adapted to receive condensed refrigerant and to discharge the condensed refrigerant into the interior of the evaporating heat exchanger 12 for evaporation and production of a cooling effect. A subcooling condenser/receiver 20 is located proximate to the evaporating heat exchanger 12 and the associated expansion valve 18 for purposes of forming a liquid seal and subcooling the refrigerant immediately upstream of the expansion valve 18.

The evaporating heat exchanger 12 is preferably of a conventional construction appropriate for cooling air but may be any heat exchanger appropriate for the medium being cooled. An open rear surface 22 of the heat exchanger 12 receives air to be cooled and discharges cooled air at an open front surface 24. An electric fan 26 serves to produce air flows along a flow path between the rear and front surfaces 22, 24. The path in which the refrigerant is evaporated is defined by copper tubing 28 commonly associated with aluminum fins (not illustrated) that serve to enhance heat exchange between the air flows and the refrigerant flows.

The expansion valve 18 has a high pressure inlet 30 where liquid refrigerant under pressure is received and a low pressure outlet 32 communicating with an inlet end of the copper tubing 28 associated with the evaporating heat exchanger 12. Condensed refrigerant is consequently injected into the evaporating heat exchanger 12, which is characterized by comparatively low pressures, and evaporates to produce a cooling effect. A temperature sensor 34 may be placed in a conventional manner at the outlet end of copper tubing 28 to detect the temperature of the spent refrigerant and to operate the expansion valve 18 in a manner which produces a required measure of cooling.

The compressor 14 has a low pressure inlet 36 which is coupled by a suction line 38 to the outlet 52 (FIG. 2) of the subcooling condenser/receiver 20. The inlet 50 of the subcooling condenser/receiver 20 is coupled to the outlet of the copper tubing 28 associated with the evaporating heat exchanger 12 to receive the spent refrigerant. The compressor 14 is conventional, incorporating an electric motor, cylinders and appropriate valves (not illustrated) to compress the return refrigerant flows. A high pressure outlet 40 of the compressor 14 is coupled by a discharge line 42 to a refrigerant inlet 44 of the condensing heat exchanger 16. The compressed refrigerant travels through a flow path defined by bent tubing 46. An electric fan 48 serves to produce ambient air flow along a flow path between the rear and front of the aluminum finned condenser 16. The cooled refrigerant is discharged from an outlet 54 of the condensing heat exchanger 16 into a liquid line 56 leading to the subcooling condenser/receiver 20. The compressor 14 and the condensing heat exchanger 16 used to cool the compressed refrigerant will often be located in close proximity, usually out of doors remote from the evaporating heat exchanger 12. Accordingly, the liquid line 56 may run a great distance to return cooled refrigerant to the evaporating heat exchanger 12.

The subcooling condenser/receiver 20 (FIG. 2) has a liquid inlet 58 for receiving the cooled refrigerant, a receiver 60 for accumulating the condensed, subcooled liquid refrigerant, a liquid outlet 62 which discharges the liquid refrigerant to the high pressure inlet 30 of the expansion valve 18 and an integral suction line with inlet 50 and outlet 52 which carries the spent refrigerant through the receiver absorbing the heat of final condensing and subcooling the refrigerant. As will be more apparent from the following description of the subcooling condenser/receiver 20, this arrangement produces a liquid seal, subcools the liquid refrigerant, and fills the liquid line 64 extending from the liquid outlet 62 to the high pressure inlet 30 of the expansion valve 18 completely with condensed, subcooled refrigerant. The liquid line 64 is preferably no more that 48 inches in length in order to reduce pressure drops along the resulting solid liquid line 64.

Figure 2:
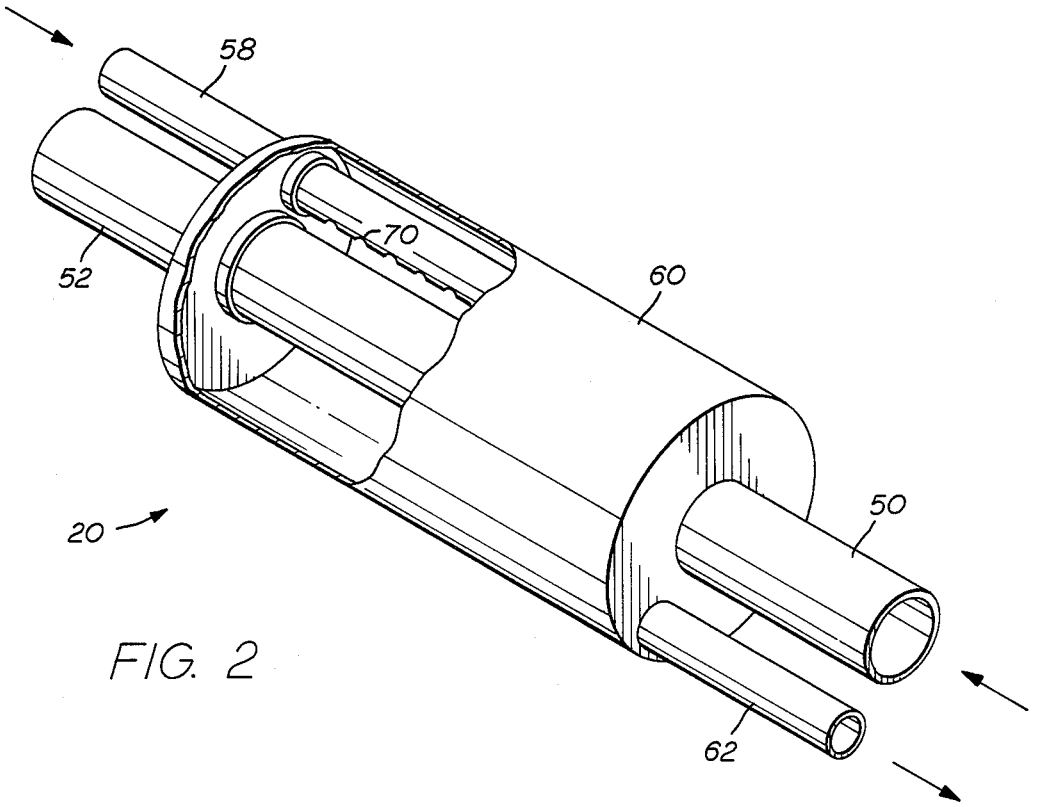
FIG. 2 is a fragmented perspective view illustrating a subcooling condenser/received according to the present invention.

The subcooling condenser/receiver 20 is better illustrated in the perspective view of FIG. 2. The subcooling condenser/receiver 20 has a generally cylindrical receiver 60 preferably formed of copper or steel and insulated (insulation not illustrated) so that no heat is absorbed by the subcooled refrigerant. The inlet 58 and the outlet 62 are preferably copper tubing and it should be noted that the outlet 62 should be oriented at the bottom of the receiver 60 during installation to prevent pooling of compressor lubricating oil circulating with the refrigerant.

The liquid inlet 58 is generally a blind-ended copper tube located within the receiver 60 for receipt of cooled refrigerant conveyed along the liquid line 56. The liquid inlet 58 contains orifices 70, the size of each being exaggerated for purposes of illustration, which present to the refrigerant received at the inlet 58 a predetermined cross-sectional flow area. In the preferred embodiment, the cross-sectional flow area defined by the orifices corresponds to approximately 60% of the minimum cross-sectional flow of the outlet 62, and more generally, to the high pressure inlet 30 of the expansion valve 18. Accordingly, the orifice tubing introduces a flow restriction and associated pressure drop between the liquid inlet 58 and the receiver 60. This restriction serves to retain condensed, subcooled refrigerant accumulating in the receiver 60 and serves to develop a solid liquid line along the liquid path extending from the receiver 60 to the high pressure inlet 30 of the expansion valve 18. The thermal communication between the suction line 38 and the liquid refrigerant in the receiver 60 ensures proper condensing of any flash gas present and subcools the liquid refrigerant prior to entering the high pressure inlet 30 of the expansion valve 18. Accordingly, eliminating the flash gas that is present in most systems due to the friction loss in the liquid line 56 and then subcooling the liquid before it leaves the receiver 60 ensures volumetric flow efficiency in the system 10.

A brief description of the operation of the refrigeration system 10 will be provided to ensure that the invention is properly understood. Spent refrigerant from the evaporating heat exchanger 12 is piped through the receiver 60 to the compressor 14 and discharged into the high pressure discharge line 42. The compressed refrigerant whose temperature is raised by compression is then subject to heat exchange with the ambient air in the condensing heat exchanger 16. The cooled refrigerant is then condensed, subcooled, and accumulated in the receiver 60 associated with the subcooling condenser/receiver 20 by the combination of the flow restriction and the subcooling effect provided by the suction line 38. This ensures that condensed, subcooled liquid is presented by means of the liquid line 64 to the high pressure inlet 30 of the expansion valve 18 for expansion and discharged into the comparatively low pressure region in the interior of the evaporating heat exchanger 12. The high pressure line 42 extending from the compressor 14 to the inlet 58 of the subcooling condenser/-received stage 20 is operated without a liquid seal. The liquid seal will be maintained from the receiver 60 to the high pressure inlet 30 of the expansion valve 18. Because the subcooling condenser/receiver 20 is positioned proximate to the expansion valve 18, the head pressure which must be developed by the compressor 14 to circulate the refrigerant at a desired rate is significantly reduced. This arrangement results in reduced compressor power requirements and consequently in energy savings.

The foregoing disclosure and description of the invention are illustrative and explanatory of the invention, and various changes in the size, shape and materials, as well as in the details of the illustrated construction and process may be made without departing from the spirit of the invention, all of which are contemplated as falling within the scope of the appended claims.

I claim:

1. A refrigeration system, comprising:

compressor means for compressing refrigerant and having an inlet and outlet;

a condensing heat exchanger having an inlet and an outlet, said condensing heat exchanger inlet being connected to said compressor means outlet;

housing means having two ends for receiving and accumulating refrigerant;

an inlet tube located at one end of said housing means and opening into said housing means, said inlet tube being connected to said condensing heat exchanger outlet;

said inlet tube, including means for providing a pressure drop to the refrigerant entering said inlet tube;

an outlet tube located at the second end of said housing means and opening into said housing means;

an expansion device having an inlet and an outlet, said expansion device inlet being connected to said outlet tube;

an evaporating heat exchanger having an inlet and an outlet, said evaporation heat exchanger inlet being connected to said expansion device outlet; and a suction tube passing through said housing means and having a first and a second end, said first end being connected to said evaporating heat exchanger outlet and said second end being connected to said compressor means inlet.

2. The apparatus of claim 1, wherein said pressure drop means comprises a plurality of orifices located in said inlet tube.

3. The apparatus of claim 2, wherein the flow area of said orifices is approximately 60% of the flow area of said outlet tube.

4. The apparatus of claim 1, wherein said housing means is cylindrical, said suction tube is cylindrical and coaxial with said housing means, said inlet tube axis is parallel to said housing means axis, said outlet tube axis is parallel to said housing means axis, and said outlet tube and inlet tube are diametrically opposed.

* * * * *